US008006616B2

(12) United States Patent
Kleinschnitz et al.

(10) Patent No.: US 8,006,616 B2
(45) Date of Patent: Aug. 30, 2011

(54) INK APPLICATOR FOR PRINTING ROLLER

(75) Inventors: Josef Kleinschnitz, Greussenheim (DE); Frank Kirchner, Zell (DE)

(73) Assignee: KBA-Metronic AG, Veitshochheim (DE)

( * ) Notice: Subject to any disclaimer, the term of this patent is extended or adjusted under 35 U.S.C. 154(b) by 612 days.

(21) Appl. No.: 12/128,807

(22) Filed: May 29, 2008

(65) Prior Publication Data

US 2008/0295718 A1 Dec. 4, 2008

(30) Foreign Application Priority Data

May 29, 2007 (DE) ..... 10 2007 025 166

(51) Int. Cl.
*B41F 31/06* (2006.01)
*B41F 31/04* (2006.01)

(52) U.S. Cl. ..... 101/350.6; 101/157; 101/167; 101/364

(58) Field of Classification Search ..... 101/350.6, 101/350.1, 363, 364, 366, 169, 157
See application file for complete search history.

(56) References Cited

U.S. PATENT DOCUMENTS

| | | | | |
|---|---|---|---|---|
| 5,345,867 | A | 9/1994 | Schneider | 101/363 |
| 5,656,083 | A | 8/1997 | Schoenberger | 118/107 |
| 6,053,102 | A | 4/2000 | Schoenberger | 101/364 |
| 6,289,807 | B1 * | 9/2001 | Kutzner et al. | 101/350.1 |
| 6,439,116 | B1 * | 8/2002 | Schafer et al. | 101/350.6 |

FOREIGN PATENT DOCUMENTS

| | | |
|---|---|---|
| DE | 29600219 | 4/1996 |
| DE | 102005050735 | 4/2007 |

* cited by examiner

*Primary Examiner* — Judy Nguyen
*Assistant Examiner* — Leo Hinze
(74) *Attorney, Agent, or Firm* — Andrew Wilford

(57) ABSTRACT

A printing roller has an outer surface and is rotatable in a rotational sense about a roller axis. A liquid applicator has an upstream blade having an edge engageable with the roller surface and a downstream blade having an edge engageable with the roller surface downstream in the sense from the upstream-blade edge. The blades form a compartment fillable with a liquid to be applied to the roller outer surface. The upstream blade is shifted on rotation of the roller between an engaged position with the respective edge engaging the surface and a disengaged position with the respective edge spaced radially from the surface.

15 Claims, 6 Drawing Sheets

INK APPLICATOR FOR PRINTING ROLLER

FIELD OF THE INVENTION

The present invention relates to a liquid applicator. More particularly this invention concerns an ink applicator for a printing roller and a method of operating such an applicator.

BACKGROUND OF THE INVENTION

A typical ink applicator for a printing roller has at least one upstream or working doctor blade and at least one downstream or closing doctor blade having flexible edges, which may be removable, that can bear radially on the normally cylindrical outer surface of the printing roller. The blades form a normally upwardly open compartment that is filled with the treatment liquid, e.g. ink, that can flow onto the roller surface via the opening formed between the blade edges. The downstream (closing) blade scrapes off excess ink so that what is left in the depressions on the roller surface can be transferred to another roller or directly to the medium being printed, which is pressed against the printing roller at a location offset from the applicator. Alternately in the anilox system the applicator applies the ink to a transfer roller that in turn applies it to the actual printing cylinder, in which case the term "printing" roller refers to this transfer roller.

The closing or upstream blade lying opposite the working or downstream blade serves essentially to seal the opening of an ink chamber with respect to the ink transfer roller when the ink transfer roller is at rest, i.e. when the ink located in the ink chamber is completely distributed in the ink chamber.

During operation when the printing or transfer roller is rotating, this rotation can bring foreign bodies such as dust, grains of sand, chips or other disturbing contaminants entrained by the printing ink remaining on the ink transfer roller after an ink transfer to collect in the area between the upstream blade and the ink transfer roller. Since with known printers the upstream blade, like the downstream blade, bears virtually all the time against the surface of the ink transfer roller with a predetermined force and the upstream blade seen in the direction of rotation of the ink transfer roller as a rule forms an acute angle with the surface of the ink transfer roller, these particles are impossible to remove bodies from under the upstream blade. The result is that they collect there and can scratch or score the roller. Since the downstream blade is oppositely angled, particles do not get wedged under it; instead they simply pass up and remain in the body of ink held in the applicator compartment, where they do no harm.

Moreover, the rotation of the ink transfer roller and the transport effect associated therewith of the ink transfer roller in connection with the printing ink still located on the surface of the ink transfer roller, over the course of time and depending on the hardness of the foreign bodies, the foreign bodies will thereby be pulverized more or less quickly, through which the doctor blades and the surface of the ink transfer roller are likewise damaged, in particular with hard foreign bodies such as grains of sand.

As a result, ink-transfer properties of the ink transfer roller thereby change in this area, with the result that at these points undesirable ink stripes occur in the printed image. If the damage to the ink transfer roller and/or to the doctor blade thereby exceed a permissible value for the achievable print quality, the ink transfer roller and/or the doctor blade must be replaced, which in particular in cases of a replacement of an ink transfer roller can result in considerable expense and in any case leads to a stoppage of the printer.

There is also during the operation of an ink transfer roller due to the continuous friction between the ink transfer roller and the downstream printing rollers and in particular due to the abrasive effect of the doctor blades on the surface of the ink transfer roller, continuous wear of the grid-like surface of the ink transfer roller, with the result that the volumes of the pockets formed on the surface of the ink transfer roller over the course of time are consistently reduced and thus the quantity of ink that can be transferred is continuously reduced. This results in a reduction of the print quality, since the ink densities of the respective print extracts are inevitably reduced.

OBJECTS OF THE INVENTION

It is therefore an object of the present invention to provide an improved ink applicator for printing roller.

Another object is the provision of such an improved ink applicator for printing roller that overcomes the above-given disadvantages, in particular that largely avoids damage caused as described above so as to increase the service life of the ink transfer roller and of the doctor blades.

A further object is to increase the service life of the ink transfer roller by reducing abrasion of the surface of the ink transfer roller by foreign bodies brought to the surface of the ink transfer roller and thereby to increase the service life of the ink transfer roller and of the doctor blades.

Yet another object is to reduce the abrasive effect of the doctor blades on the ink transfer roller and to hereby increase the service life of the ink transfer roller.

SUMMARY OF THE INVENTION

In combination with a printing roller having an outer surface and rotatable in a rotational sense about a roller axis, a liquid applicator has according to the invention an upstream blade having an edge engageable with the roller surface, a downstream blade having an edge engageable with the roller surface downstream in the sense from the upstream-blade edge. The blades forming a compartment fillable with a liquid to be applied to the roller outer surface, and means for shifting the upstream blade on rotation of the roller between an engaged position with the respective edge engaging the surface and a disengaged position with the respective edge spaced radially from the surface.

In other words at least one of the blades can be adjusted from a position in contact with the surface of the ink roller into a position raised off the surface of the ink roller. Furthermore, the object is attained by a printer with an ink applicator of this type in which at least one of the blades, in particular the upstream blade, can be adjusted from a position in contact with the surface of the ink roller into a position raised from the surface of the ink roller. The object is attained in terms of process engineering in that, during operation of a printer or of a printing unit with at least one ink applicator and an ink roller, the upstream blade of the ink applicator is raised at least temporarily from the ink roller and a gap forms between the upstream blade and the ink roller, through which gap foreign bodies are carried into the reservoir of the ink applicator.

The devices and the method according to the invention thus have the particular advantage that the cited foreign bodies or contaminants can no longer collect in a wedge-shaped gap between the upstream blade and the ink roller and are transported, if possible directly, into the interior of the ink applicator, since seen from the interior of the ink applicator the closing blade forms an obtuse angle with the surface (or more accurately to a tangent to the surface) of the ink roller, and a foreign body therefore cannot become wedged in this area or cause any damage. A foreign body of this type carried into the ink applicator would therefore at most circulate with the rotating ink roll forming in the reservoir, but would not cause any damage while doing so.

An adjustment of the position of a blade can thereby be made by an adjustment of the structure to which the blade is attached. Thus the one blade, in particular the upstream blade, is raised only temporarily from the ink roller. For example, the blade can adopt the position in which it contacts the ink roller only during when the printer is stopped. On start-up and also during the shut-down of the printer it is moved back into the engaged position touching the roller surface in order to close the ink applicator.

Furthermore, the blade is moved into the disengaged or raised position after start-up of the printer and held there so long as the printer is running, until the printing operation is to be stopped or other work measures are to be taken, such as filling the ink applicator or replacement, etc.

Alternatively, the blade also bears in the engaged position against the ink roller during operation of the printer, but is moved into the raised position temporarily, e.g. periodically, for a predetermined period in order to allow foreign bodies to escape from the space between the upstream blade and the ink roller, subsequently the upstream blade can be moved back in the contacting position. This movement can be repeated, for example, after predetermined intervals of time.

In another possible embodiment the upstream blade can be lifted whenever a predetermined part or parts of the roller comes or come to it. To this end a drive provided for lifting can be controlled, for example, depending on the rotational angle, for example by a cam on the ink roller.

In a preferred further development at least one blade support and its blade can assume different positions based on the surface of the ink roller and/or relative to the other blade. For example, the front edge of the blade of the one movable blade is lifted in a first disengaged position from the surface of the ink roller so that a gap is formed between the edge of the blade and the surface of the ink roller. Furthermore the front edge of the blade of the one movable blade can move into a second engaged position bearing against the surface of the ink roller without mechanical preload or with only a negligible mechanical preload and that the front edge of the blade of the one movable blade beam can be shifted into a third engaged position bears against the surface of the ink roller under a mechanical preload.

In a fourth closed position the edges of the blades bear against one another or overlap one another such that the opening of the ink applicator toward the ink roller is closed. In this position the applicator and roller can be separated, for instance to change treatment liquid by changing the applicator, or for changing the ink roller.

The front edge of the blade of the one movable blade beam can thus slide over the surface of the ink roller to reach the fourth closed position such that excess printing ink on the ink roller in this area is wiped off and moved into the ink-applicator reservoir. This closing movement can be carried out such that the ink applicator seals against the ink roller during this movement. The one movable blade beam in each of the cited positions can pivot into any desired position relative to the surface of the ink roller independent of the respective angular or radial position on the roller.

With all of the possible embodiments, movement of the one movable blade beam between the selectable positions can be carried out by means of a controlled drive.

In a preferred further development it can be provided that the ink applicator can be removed from its mount on the printer in a stationary manner only if the one movable blade beam is located in a defined predetermined position, in particular in the fourth or closed position, and the ink reservoir is thus closed with respect to the ink roller.

In a first embodiment according to the invention the upstream blade of the ink applicator is movable, since with ink applicators constructed in a conventional manner this is where foreign bodies can become wedged in the area lying outside the ink applicator between the blade and the surface of the ink roller and be driven continuously deeper into the gap by the conveyor effect of the rotating ink roller and due to their abrasive effect on the ink roller and the upstream blade, can thereby damage them.

It is therefore within the invention to lift the upstream blade beam with the blade attached thereto in the normal operation of the printing unit into a first disengaged position so far from the surface of the ink roller by means of a suitable drive that a gap forms between the surface of the ink roller and the front edge of the blade, through which gap the cited foreign bodies can be transported into the ink reservoir without thereby damaging the ink roller surface or the upstream blade.

Since due to the conveyor effect of the ink roller in normal printing operation the printing ink located in the interior of the ink applicator is conveyed toward the downstream blade and accumulates there, in addition an ink roll, e.g. a round-section body of ink rotating about an axis generally parallel to the roller axis but offset radially outward from its outer surface, forms there rotating in the opposite direction to the direction of rotation of the ink roller, which ink roll comprises virtually all of the printing ink located in the ink applicator depending on how deeply the reservoir is filled. This results in the situation that in the normal operation no printing ink is actually in contact with the upstream blade in the interior of the ink applicator, so that the upstream blade can be lifted without danger, in particular during the printing operation, at least temporarily or alternatively also permanently during operation/rotation from the surface of the ink roller, without printing ink leaking from the ink reservoir in an uncontrolled manner.

Since the formation of the ink roll also depends on the rotational speed of the ink roller, it can furthermore be provided according to the invention to adjust the size of the gap depending on the speed of the ink roller, for example, in that the current speed of the ink roller is determined by means of a speed sensor and transmitted to a higher-level controller. This controller sets the gap between the blade and the ink roller, for example, by means of a corresponding actuator on the movable blade beam.

According to the invention the first disengaged position of the movable blade beam is against a mechanical preload, for example, against spring, so that in the event of a failure, for example, in the event of a breakdown of, for example, an electrical or pneumatic drive for moving the blade beam, the movable blade beam automatically returns to a defined position, e.g. is moved into a second or third engaged or a fourth closed position, described below, through which the ink applicator engages the surface of the ink roller or is closed so that no printing ink can exit from the ink applicator in an uncontrolled manner.

Since no ink roll develops at the downstream blade when the printer is stopped, the printing ink is distributed evenly in the ink reservoir, through which printing ink reaches the upstream blade. In order in this state to prevent printing ink from flowing out of the ink reservoir, according to the invention the movable upstream blade is moved into a second position on the surface of the ink roller such that the blade bears against the surface of the ink roller without contact pressure or with only a minimal contact pressure. This ensures that, on the one hand, the gap between the blade and the ink roller is securely closed and thus no ink can exit from the ink reservoir in an uncontrolled manner and, on the other hand, foreign bodies that are located between the upstream blade and the ink roller at precisely this moment are not pressed or only slightly pressed against the surface of the ink roller.

It can be useful to operate the ink applicator in particular during the start of the printer in a conventional manner first of all with the upstream or closing blade pressed onto the surface of the ink roller blade with a substantial contact pressure. It is also possible according to the invention to move the blade beam into a third engaged position in which the blade is pressed onto the surface of the ink roller in the usual manner and with a standard force Since in particular when processing small batches of printing materials to be printed it often occurs that the printing rollers have to be cleaned or that the printing ink has to be changed, it can furthermore be provided according to the invention that the one movable blade beam can adopt a fourth closed position in which the front edges of the upstream blade and of the downstream blade lie against one another or on top of one another such that the opening of the ink reservoir to the ink roller is closed in an ink-tight manner and no printing ink can exit in an uncontrolled manner and the filled ink reservoir can easily be removed from the printer and, for example, replaced by an ink applicator filled with a different printing ink.

Furthermore according to the invention the ink applicator can be removed from the printer exclusively in its closed condition, that is, when the upstream blade beam is in the closed fourth position, in that, for example, a mechanical device, e.g., a coupling opens between the ink applicator and printing unit exclusively in the cited fourth closed position of the upstream blade beam and the ink applicator can thereby be removed. This ensures that no printing ink from a filled ink reservoir can exit in an uncontrolled manner from the ink reservoir due to an operating error.

In a further embodiment according to the invention both blade beams can be movable with their blades and each provided with a respective controllable drive, through which it is possible to operate an ink applicator of this type in both directions of rotation of the ink roller. This way both blades can preferably be moved such as described above for one of the blades.

Operation of this type of the printer and thus also of the ink roller can be necessary, for example, when cleaning of the rollers has to be carried out or when, for example, with a printer for web-shaped printing material the printing material has to be removed from the printer or when existing production machines, for example, are to be retrofitted with a printer. In particular in the latter example due to existing structural restrictions and/or for reasons of operability on the production machine to be retrofitted it is frequently not possible to install printers with only one printing direction, so that a printer for both printing directions is useful. The drive for moving the blade(s) between different positions can thereby take place electrically, pneumatically, hydraulically and/or via a mechanical coupling.

In a first embodiment according to the invention the drive itself can be mounted in a fixed holder on the printer, and power transmission to the movable blade beams can be carried out, for example, via a mechanical transmission and/or intermeshing levers and/or couplings. To this end the fixed drive can have, for example, a transmission and/or a mechanical coupling, which with an ink applicator located in its mount engages in a corresponding mechanical counterpart attached to the ink applicator in a force-closed or positive manner.

To move the one blade beam, furthermore the blade beam can be connected to the cited counterpart in a force-closed manner via corresponding movement elements, such as levers, guide devices or the like attached to the ink applicator, so that activation of the fixed drive transmits force via the cited elements to the one movable blade beam.

Through a corresponding control of the movement of the fixed drive it is thus possible to set the different positions or settings of the one movable blade beam. According to the invention it can be provided thereby that the mechanical coupling of the fixed drive and the counterpart attached to the ink applicator can be separated from one another only when the one movable blade beam is located in its fourth closed position, with the ink reservoir closed to the ink roller.

At the same time the coupling and the associated counterpart can hereby serve as a mechanical lock of the ink applicator in its mount so that removal of the ink applicator from its mount is not possible as long as the movable blade beam is located in a first, a second or a third position and the ink reservoir is thus opened to the ink roller. It is hereby possible to effectively prevent an operating error and thus uncontrolled leaking of the ink from the ink reservoir.

Removal of an ink applicator filled with printing ink is then carried out in that the one movable blade beam is brought into a cited fourth closed position by means of the controlled drive, through which, on the one hand, the ink reservoir is closed to the ink roller and, on the other hand, the cited coupling and its counterpart attached to the ink applicator depending on their embodiment are rotated or pushed into a position such that they can be easily separated from one another and the ink applicator can be removed from its mount.

It can be useful to fix the position of the movable blade beam upon removal of the ink applicator from its mount, for example, by means of blocking elements attached to the ink applicator, e.g. self-engaging fittings, so that the ink applicator is always closed in the removed state.

In a further embodiment according to the invention it can be provided to integrate the drive for moving the one movable blade beam into the ink applicator such that it is likewise removed when the ink applicator is removed from the printer.

To this end, in addition to a mechanical lock that fixes the ink applicator inserted into the holding device and at least in the cited first, second and a third position of the movable blade beam effectively prevents removal of the ink applicator from the holding device, the ink applicator can additionally have a corresponding electrical and/or pneumatic connection to the printer, depending on the drive used.

The ink applicator can thereby possibly contain additional necessary sensors to control the movement of the movable blade beam, which likewise are connected via a corresponding detachable connection to a higher-level control. The connection can thereby be embodied as a slip joint to be detached separately or as a part of the mount for the ink applicator, so that when the ink applicator is removed from the holding device at the same time the electric and/or pneumatic connections are released or when the ink applicator is placed in the holding device, they are closed.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
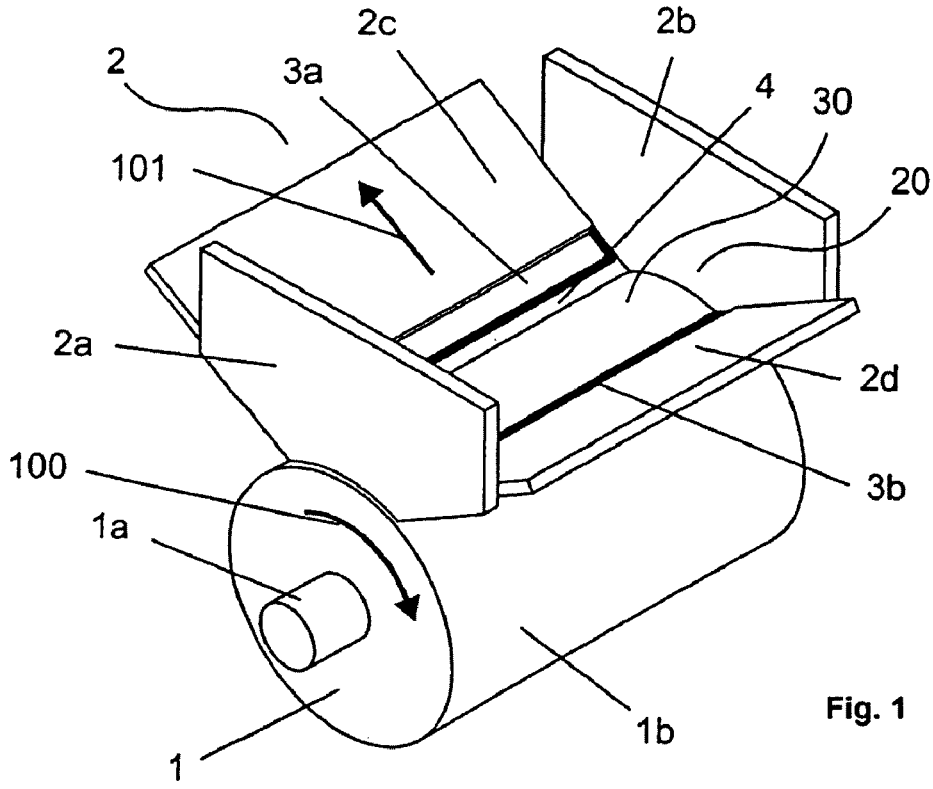
FIG. 1 is a partly schematic perspective view showing the applicator system according to the invention in the disengaged and open position of the upstream blade.

As seen in FIG. 1 an ink applicator 2 comprises essentially two end plates 2*a* and 2*b* and two blades 2*c* and 2*d* having respective edges 3*a* and 3*b* that can bear against a surface 1*b* of the ink roller 1 and, relative to a tangential plane at the contact point form a angle between 0° and 90°, preferably between 10° and 80°, particularly preferably between 20° and 70°.

The end plates 2*a* and 2*b* and the blades 2*c* and 2*d* together form a reservoir or compartment 20 holding printing ink. The ink applicator 2 is furthermore associated with an ink roller 1 such that the printing ink in the reservoir 20 can be transferred via an opening 30 formed by the end plates 2*a* and 2*b* and the blade edges 3*a* and 3*b* onto a surface 1*b* of the ink roller 1. Rotation of the ink roller 1 about its axis 1*a* in the direction 100 causes small pockets on the surface 1*b* of the ink roller 1 to be filled with printing ink. Excess printing ink is wiped off by the downstream blade edge 3*b* from the surface 1*b* of the ink roller and shifted back into the ink reservoir 20.

To seal the ink applicator on the front face to the ink roller, the end plates 2*a* and 2*b* have arcuate edges fitted to the ink roller.

According to the invention the blade 2*c* with its edge 3*a* is movable so as to adopt a first disengaged position in a first embodiment according to the invention displaced along a direction 101, in particular parallel to the plane of the blade 2*c*. Through this the upstream blade edge 3*a* is lifted from the surface 1*b* of the ink roller 1 such that a gap 4 forms between the front edge of the blade edge 3*a* and the surface 1*b* of the ink roller 1.

On rotation of the ink roller 1 about its rotational axis 1*a* in the direction 100 in normal operation a rotating ink roll (not shown) forms in the reservoir 20 of the ink applicator 2, which ink roll essentially bears against the inside of the downstream blade edge 3*b*, such that the upstream blade edge 3*a* can be lifted without danger from the surface 1*b* of the ink roller 1 without printing ink leaking out of the ink applicator 2 in an uncontrolled manner. This way the contaminants mentioned above can no longer become wedged between the upstream blade edge 3*a* and the surface 1*b* of the ink roller 1 and damage the ink roller surface 1*b* and/or the upstream blade edge 3*a*, but are instead transported into the reservoir 20 of the ink applicator 2.

Figure 2:
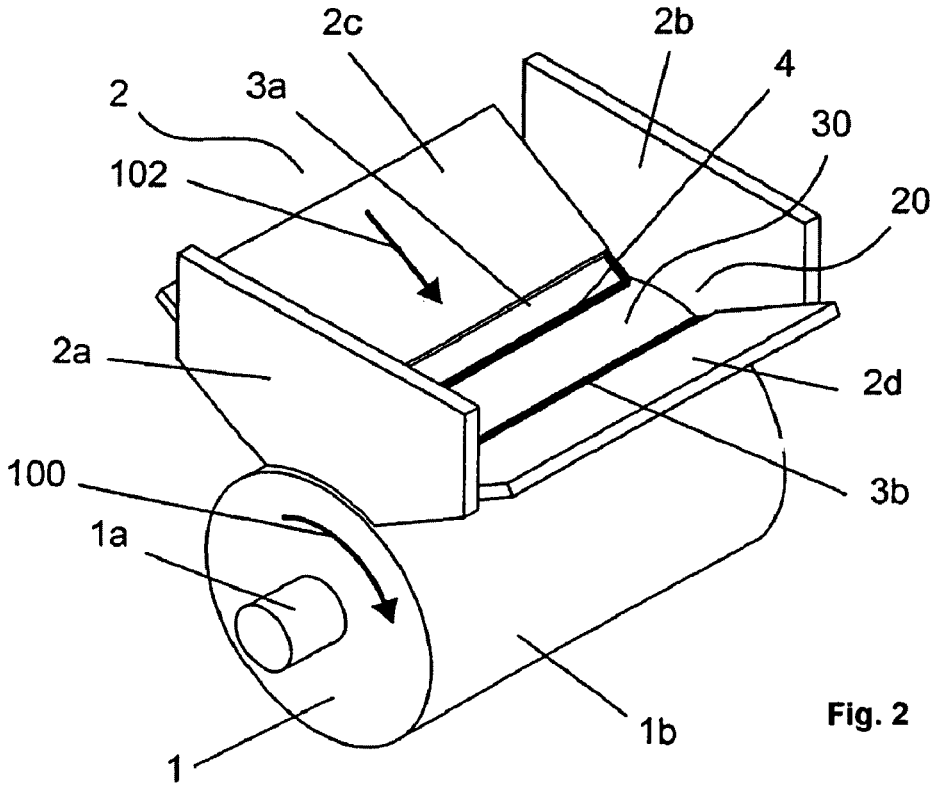
FIG. 2 is a view like FIG. 1 with the upstream blade in the engaged and open position.

In the event of a stoppage of the ink roller or with a slow rotational movement, for example during test runs or for adjustment purposes on the printer it can occur that the cited ink roll does not form or forms inadequately and thus printing ink likewise flows to the upstream blade edge 3*a*, so that it is advisable to place the upstream blade edge 3*a* in a second engaged position on the surface 1*b* of the ink roller 1 without pressure or with a slight contact pressure or also in a third engaged position with higher contact pressure on the surface 1*b* of the ink roller 1, so that the opening 30 to the ink roller 1 is sealed on all sides and thus no printing ink can exit in an uncontrolled manner, as shown in FIG. 2.

Movement of the movable blade 2*c* its edge 3*a* between a first disengaged and a second or third engaged position can take place, for example, in a linear manner along the directions of movement 101 or 102, for example, in that the movable blade 2*c* is moveably supported in corresponding first guides and can be moved by means of an external adjustment device (not shown).

Figure 3:
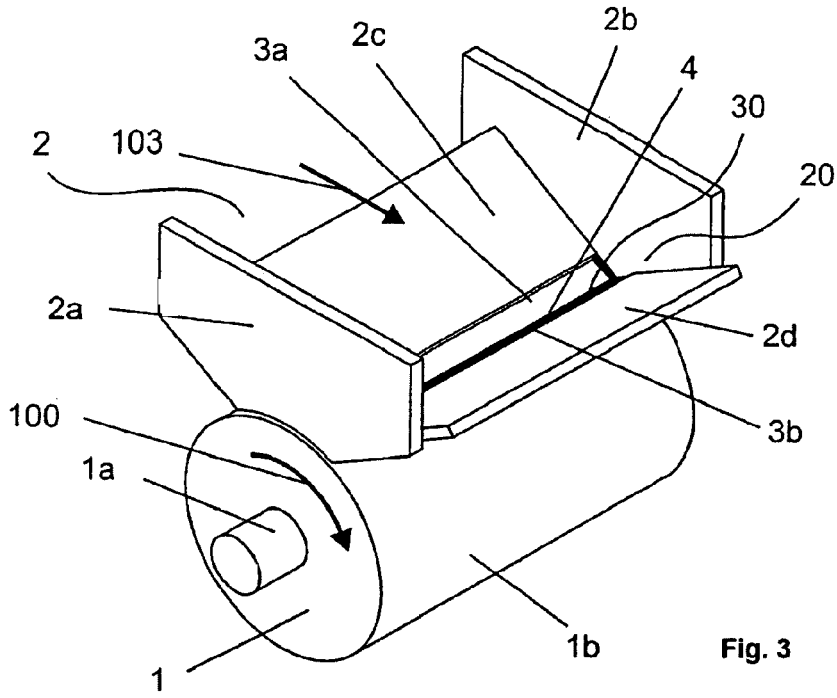
FIG. 3 is a view like FIG. 1 with the upstream blade in the engaged and closed position.

Furthermore according to the invention the movable blade 2*c*, as shown in FIG. 3, can adopt a fourth closed position in which the upstream blade edge 3*a* bears against the downstream blade edge 3*b*, or the blade edges 3*a* and 3*b* come to rest one on top of the other such that the opening 30 of the ink applicator to the ink roller is closed and even on separation of the ink applicator from the printer no printing ink can hereby exit in an uncontrolled manner.

To this end, for example, the movable blade 2*c* is displaced in a direction 103 until the blade edges 3*a* and 3*b* rest against one another or overlap one another and the opening 30 is closed. It can be useful thereby to carry out the movement along the direction 103 such that the front edge of the blade edge 3*a* always bears against the surface 1*b* of the ink roller 1 with a certain contact pressure and during this movement along the direction 103 brushes over the surface 1*b* of the ink roller 1 and wipes it off, through which a printing ink lying on or adhering to the surface 1*b* is conveyed into the interior of the ink applicator. Thus the blade edge 3*a* moves along a circular arc centered on the rotation axis of the roller 1.

Figure 4:
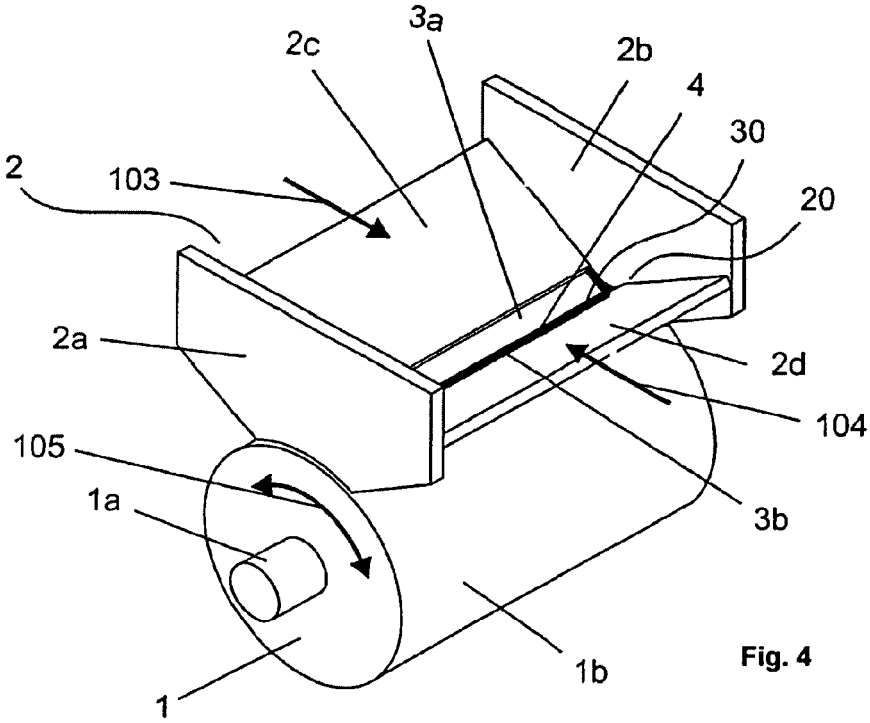
FIG. 4 is a view like FIG. 3 but with reverse rotation of the applicator roller.

FIG. 4 shows a second embodiment according to the invention of an ink applicator with two movable blades, the blades being in the fourth closed position and thus the ink reservoir 20 being closed to the ink roller 1. According to the invention in this embodiment both of the blades 2*c* and 2*d* are movable and each can assume a first disengaged position, a second or third engaged position, and a fourth closed position.

According to the invention these blades 2*c* and 2*d* can move between first disengaged position, the second engaged position, the third engaged position, and the fourth closed position as in FIG. 1. Obviously, however, as indicated by double-headed arrow 105, either of the blades 2*c* or 2*d* can be the upstream blade, depending on rotation direction. This system is useful in many modern setups where a web is moved in either direction through the printer. With this embodiment the blades 2*c* and 2*d* their own actuators that can operate independently of one another. This also makes it possible as shown in FIG. 4 for the fourth closed position be assumed by moving both blades 2*c* and 2*d* symmetrically together along the directions 103 and 104 until the opening 30 is closed.

Figure 5:
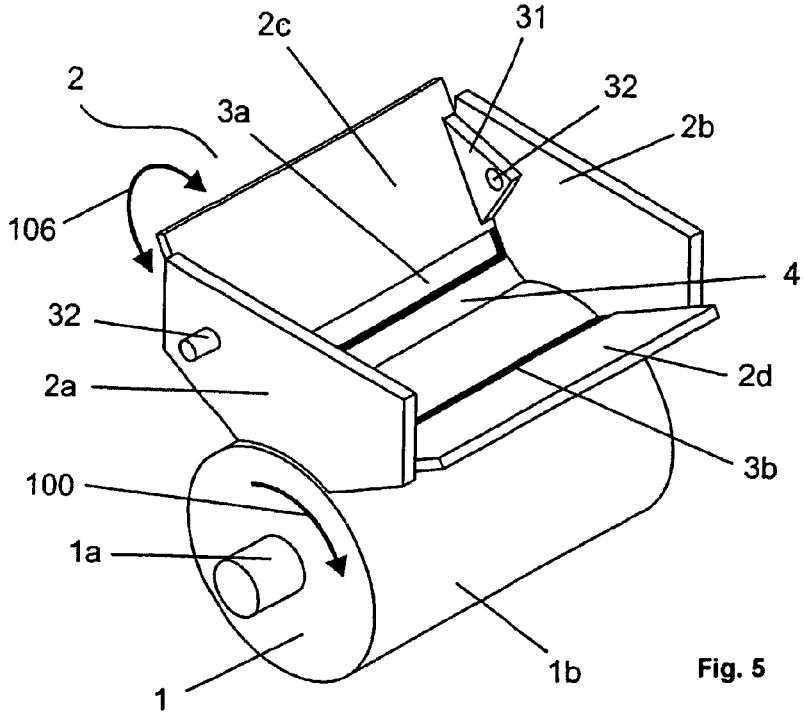
FIG. 5 is a view like FIG. 1 of an alternative system according to the invention.

FIG. 5 shows a third embodiment according to the invention of an ink applicator, where the one movable blade 2*c* with the edge 3*a* can pivot about an axis, in order thus, for example, to be brought from a first into a second or third position. To this end the blade is pivoted, for example, via holders 31 about a rotational axis 32 and is connected to a corresponding control drive (not shown). It can be useful thereby to adopt the cited fourth closed position to provide additional linear movement devices, for example, via carriages, friction bearings or guide slots such simultaneous rotary and/or pivoting and/or a linear movements can be executed.

In particular in this embodiment according to the invention it is also possible depending on the control of the drives of the rotational and/or of the linear movement elements to adjust the blade edge 3*a* with different inclination angles on the surface 1*b* of the ink roller 1 in order to thus adjust different ink transfer properties of the ink roller 1 or, for example, in order to compensate for speed-related ink transfer properties of the ink roller 1 and/or of the printer.

Figure 6:
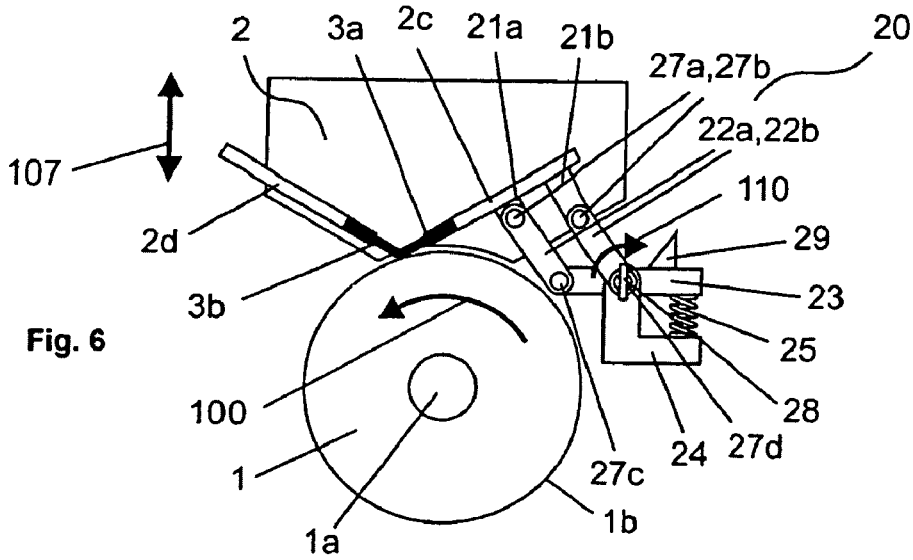
FIGS. 6, 7, and 8 are schematic end views showing the system in the positions of FIGS. 3, 2, and 1, respectively.
Figure 7:
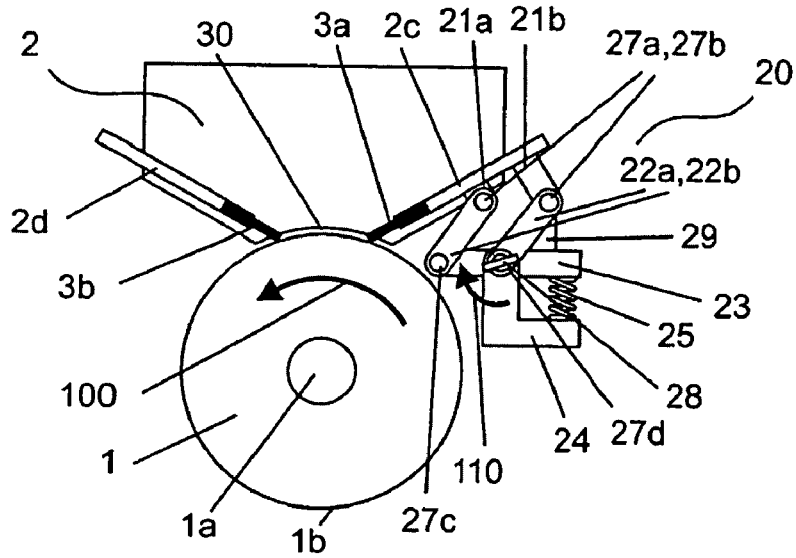
Figure 8:
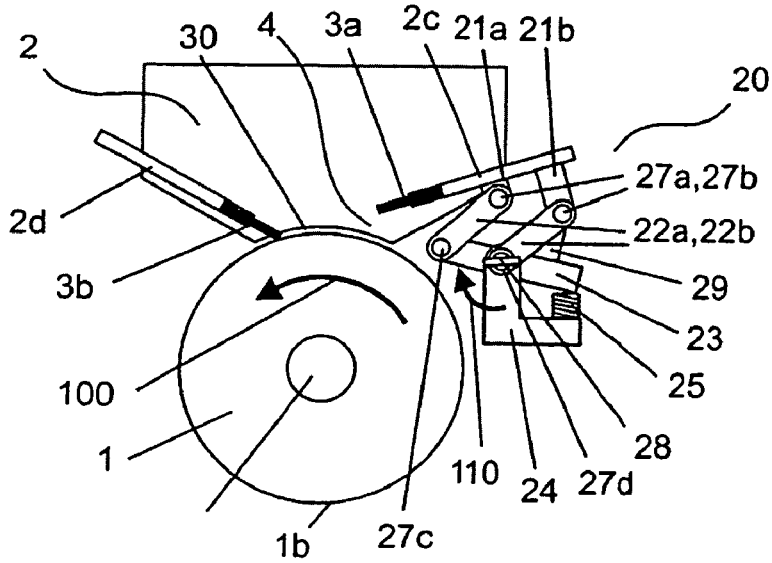

FIGS. 6, 7, and 8 are schematic diagrams of an ink applicator according to the invention with a movable blade 2*c*. In FIG. 6 the blade 2*c* is in the fourth closed position in which the opening 30 between the ink applicator 2 and ink roller 1 is closed. In this embodiment the movable blade 2*c* with its edge 3*a* can be pivoted by means of a parallel lifter-type mechanical drive 20 between a fourth closed position and a second or third engaged position, as shown in respective FIGS. 6 and 7.

The drive 20 can, for example, comprise arms 21*a* and 21*b* attached to the blade 2*c* and forming parallel upper pivots 27*a* and 27*b* coupled via respective links 22*a* and 22*b* to pivots 27*c* and 27*d* on a lower support bar 23. The support bar 23 can rotate limitedly about the pivot 27*b* on a mount 24. A spring 25 is braced between the mount 24 and the bar 23 to urge the blade 2*c* into the second engaged position, as shown in FIG. 7. A coupling element 28 forming part of an actuator is angularly fixed to the link 22*b* so that rotating it can move the parallelogrammatic linkage through the positions of FIGS. 6, 7, and 8.

It can be useful to integrate further elements (not shown) into the drive, such as, for example, springs and/or mechanical stops in order, for example, to exert a certain force on the blades with their front edges bearing against one another and thus to support the tightness of the ink applicator.

Rotation in the direction 110 about the axis of the pivot joint 27*d* pivots the blade 2*c* via the arms 21*a* and 21*b*, the links 22*a* and 22*b* and the pivots 27*a*, 27*b*, 27*c*, 27*d* between the second or third position, as shown in FIG. 7. This way the ink applicator 2 opens to the ink roller 1 via the opening 30 and the printing ink reaches the surface 1*b* of the ink roller 1.

With further rotation in the direction 110 about the axis of the pivot joint 27*d*, for example, a further pivot motion of the parallel lifter 20 is prevented by a stop 29, against which, for example, the arm 22*b* strikes, and a joint rotation of the elements fixed in this position with respect to one another, comprising the blade 2*c* with its edge 3*a*, the arms 21*a* and 21*b*, the links 22*a*, 22*b* and the bar 23 can take place against the compression spring 25 so at to lift the blade edge 3*a* from the surface 1*a* of the ink roller 1 and thus form the gap 4.

Due to the force of the spring 25, the opening 4 remains as long as a force is exerted from the external drive via the coupling 28 so that, for example, in the event of a failure with a breakdown of the external drive the blade 2*c* will automatically swing back into a second or third position or even via unillustrated springs into the fourth closed position, so that the gap 4 is closed and no printing ink can exit from the ink applicator in an uncontrolled manner.

In order furthermore to prevent that an ink applicator 2 that is open toward the ink roller 1 via the opening 30 can be removed from the printer, it can furthermore be provided according to the invention that the coupling 28 has, for example, a preferred direction in which it engages in its corresponding counterpart (not shown). According to the invention, for example, this preferred direction lies parallel to a removal direction 107 for the ink applicator 2, which is predetermined via a corresponding mount for the ink applicator 2, such that the ink applicator 2 can be removed from the printer in the fourth closed position of the movable blade 2*c* shown in FIG. 6 only in direction 107 in which the front edges of the blade edges 3*a*, 3*b* bear against one another such that the ink applicator 2 is closed to the ink roller 1. However, in every other position, such as, for example the first, second or third position of the blade 2*c*, as shown in FIG. 7 or in FIG. 8, or also in a desired intermediate position, the ink applicator 2 is fixed via the coupling 28 in the mount of the ink applicator 2 such that a removal is not possible.

It can be useful to provide further locking devices for this purpose such as, for example, controllable and movable clamps or studs on the ink applicator 2 or at its mount, wherein the locking devices exclusively in the cited fourth closed position of the blade 2*c* are opened for removal of the ink applicator 2 from its mount.

Figure 11:
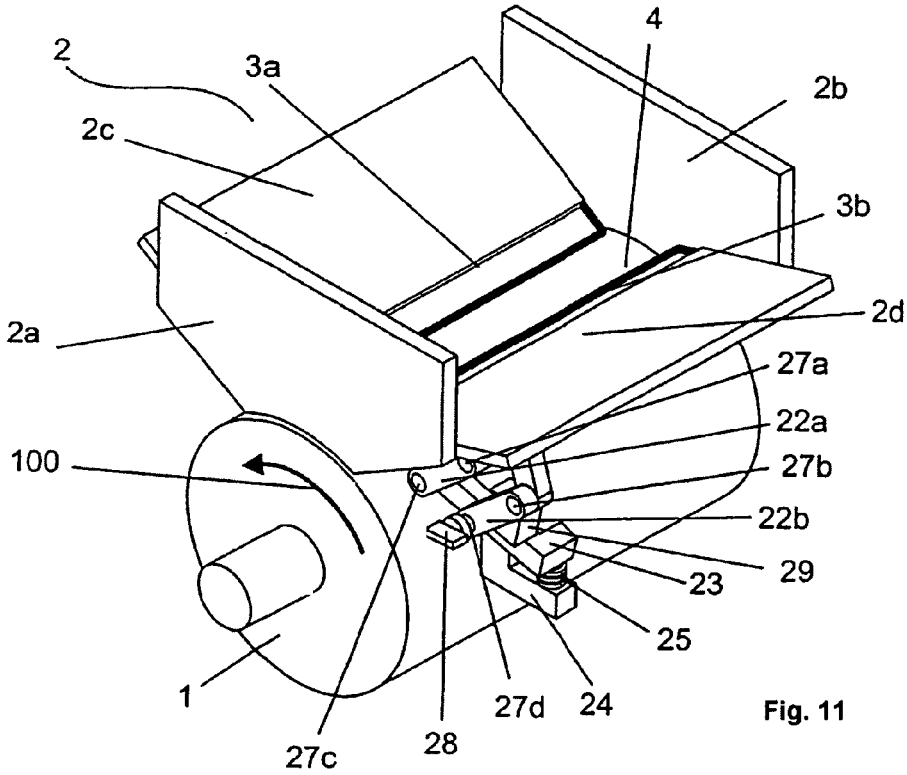
FIGS. 9, 10, and 11 are perspective views of the system as shown in FIGS. 6, 7, and 8, respectively.
Figure 9:
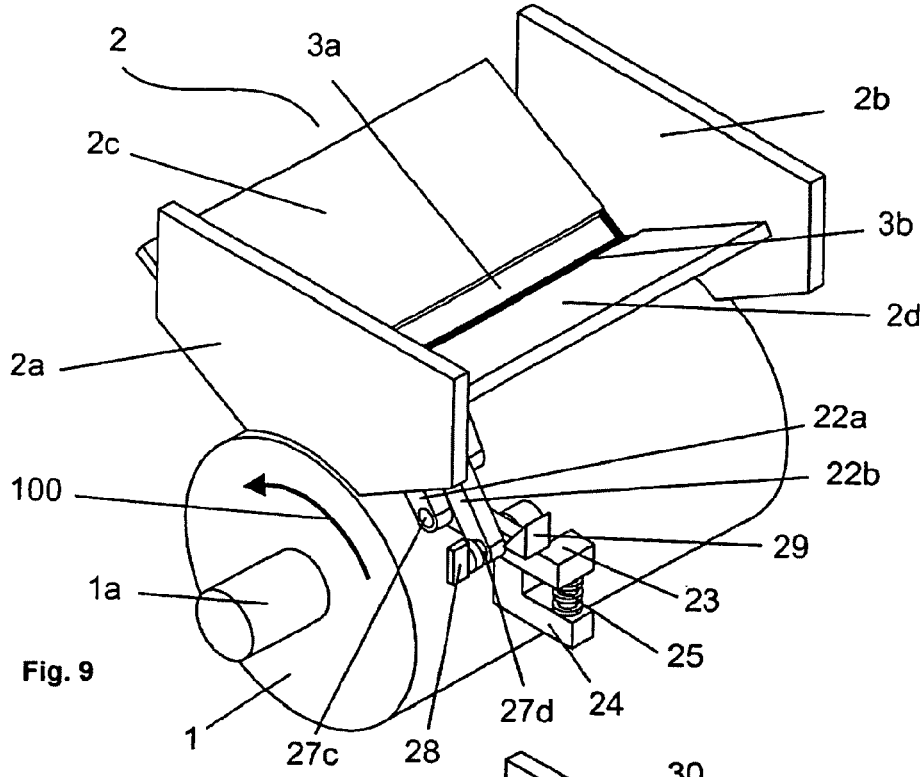
Figure 10:
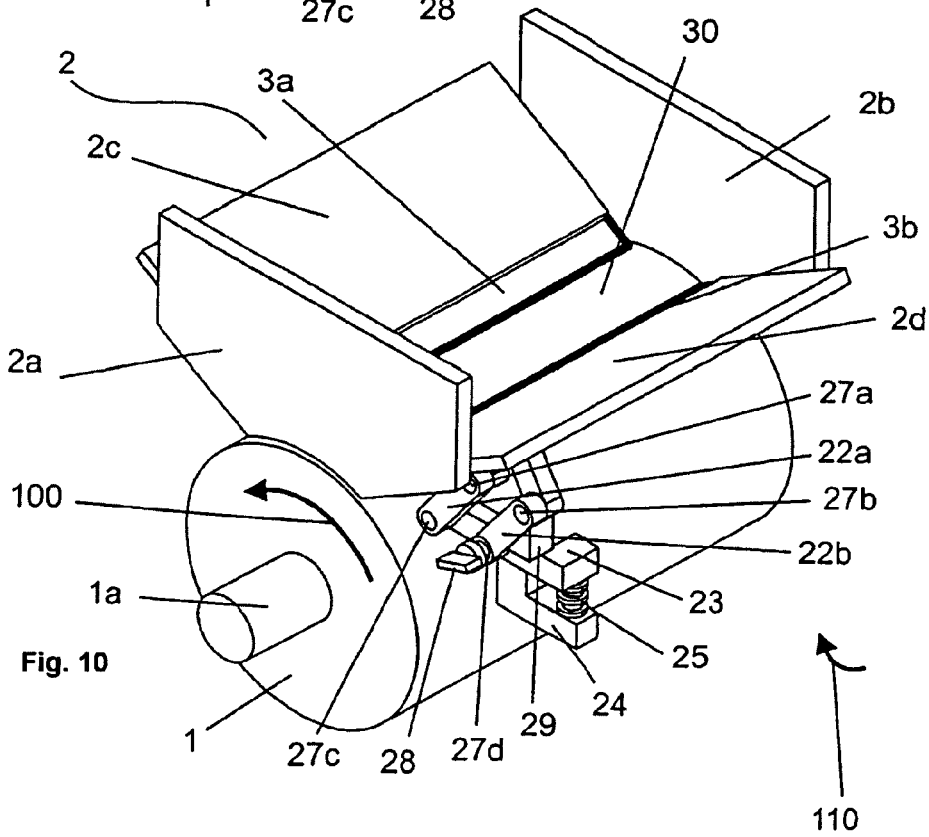

FIGS. 9, 10, 11 show the embodiment according to the invention cited in FIGS. 6, 7, 8 for the purpose of clarification in a perspective views.

FIGS. 12, 13, 14, and 15 show another embodiment according to the invention according to a principle as shown in FIGS. 6, 7, 8 for moving a blade, with the difference that both of the blades 2*c*, 2*d* are respectively embodied in a movable manner and have respective drives 20*a* or 20*b*.

Figure 13:
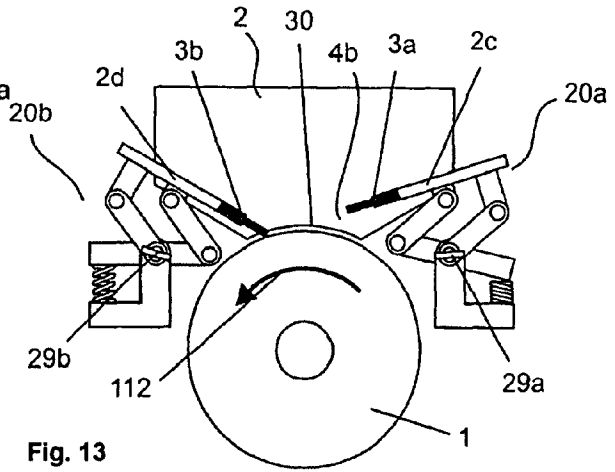
FIGS. 12, 13, 14, and 15 are end views of a bidirectional system with FIGS. 12 and 13 showing the equivalent of the FIG. 1 position and FIGS. 14 and 15 showing the positions of FIGS. 2 and 3.
Figure 12:
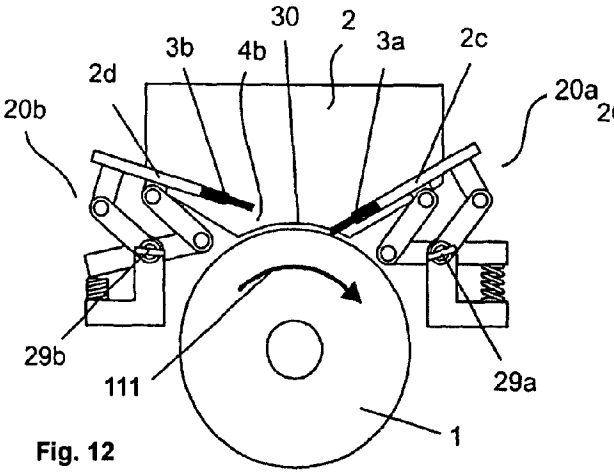

This way it is possible to operate an ink applicator 2 of this type independently of the direction of rotation of the ink roller 1, wherein, as shown in FIG. 12, with a rotation direction 111 of the ink roller 1, the blade edge 3*a* of the blade 2*c* is used as the downstream blade and accordingly the blade edge 3*b* of the blade 2*d* is used as the upstream blade or vice versa as shown in FIG. 13 according to a rotation direction 112 of the ink roller 1, the blade edge 3*b* of the blade 2*d* is used as the downstream blade and accordingly the blade edge 3*a* of the blade 2*c* is used as the upstream blade.

If the blade edges 3*a* and 3*b* and the blades 2*c* and 2*d* move into a second or a third or a fourth closed position or if the ink applicator is to be operated in a conventional manner, the direction of rotation 113 of the ink roller 1 can set accordingly, since in this case no gap 4*a* or 4*b* is formed and thus no printing ink can exit from the ink applicator 2 in an uncontrolled manner.

Figure 15:
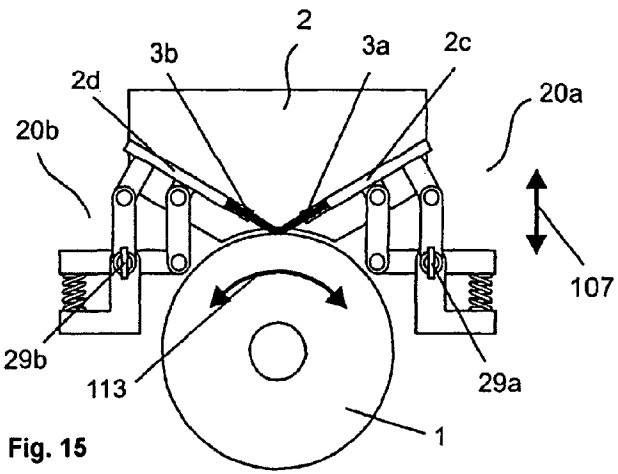
Figure 14:
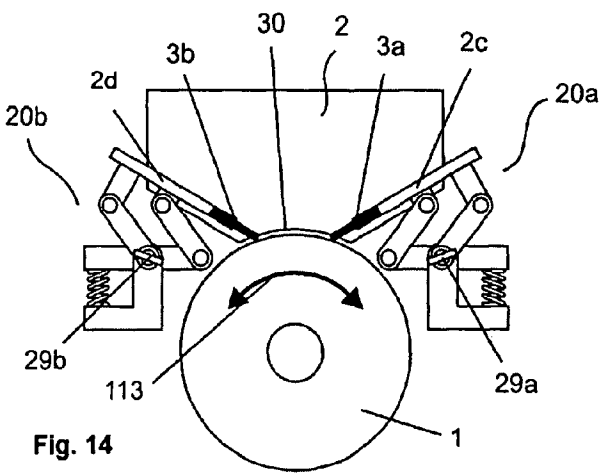

Each of the drives 20*a* and 20*b* can here have a respective coupling 28*a* or 28*b* with the above cited features, and a respective independently controllable drive, so that the ink applicator 2 can be removed from its mount in a similar manner only if both couplings 28*a* and 28*b* are in the fourth closed position, as shown in FIG. 15, so that the ink applicator can be moved in direction 107 from its mount.

With regard to all of the embodiments in the general or specific part of the specification it should be noted that the technical features cited in connection with one embodiment can be used not only with this embodiment, but also with the other embodiments. All of the disclosed technical features of this invention specification are to be classified as essential to the invention and can be combined as desired with one another or can be used alone.

We claim:

1. In combination with a printing roller having an outer surface and rotatable in a rotational sense about a roller axis, a liquid applicator comprising:

an upstream blade having an edge engageable with the roller outer surface;

a downstream blade having an edge engageable with the roller outer surface downstream in the sense from the upstream-blade edge, the blades forming a compartment fillable with a liquid to be applied to the roller outer surface; and means for shifting the upstream blade on rotation of the roller between an engaged position with the respective edge engaging the roller outer surface and a disengaged position with the respective edge spaced radially from the roller outer surface and for moving the upstream-blade edge between an open position spaced from the downstream-blade edge and a closed position engaging the downstream-blade edge.

2. The combination defined in claim 1 wherein the shifting means can move the upstream-blade edge between the open position and the closed position when the upstream blade is in the disengaged position.

3. The combination defined in claim 1 wherein the shifting means can move the upstream-blade edge between the open position and the closed position when the upstream blade is in the engaged position.

4. The combination defined in claim 1 wherein in the closed position the liquid cannot pass between the edges to the roller outer surface.

5. The combination defined in claim 1 wherein the shifting means is connected to one of the blades and the other blade is stationary.

6. The combination defined in claim 5, further comprising:

shifting means connected to the downstream blade for moving same along the roller outer surface of the roller between a respective open position with its edge spaced from the upstream-blade edge and a respective closed position with its edge engaging the upstream-blade edge.

7. The combination defined in claim 6 wherein the roller can rotate in two opposite directions about the axis, the combination further comprising means for detecting rotation direction of the roller and for shifting whichever blade is upstream from the engaged to the disengaged position when the roller rotates.

8. The combination defined in claim 1 wherein the upstream blade lies generally in a plane and the shifting means moves the upstream blade generally parallel to the plane between the engaged position and the disengaged position.

9. The combination defined in claim 8 wherein the plane forms with another plane tangential to the roller outer surface at the upstream-blade edge an acute angle open upstream away from the downstream blade.

10. The combination defined in claim 1 wherein the shifting means includes a parallelogrammatic linkage moving the upstream-blade edge through an arc between the open and closed positions.

11. The combination defined in claim 1, further comprising:

means for shifting both the blades radially away from the roller; and control means connected to the shifting means for moving the blades into the closed position on movement of the blades radially away from the roller, whereby liquid is trapped between the blades on such radial movement.

12. The combination defined in claim 1, further comprising:

side walls extending generally parallel to each other and perpendicular to the axis and having lower edges very closely juxtaposed with the roller outer surface, the blades extending between the side walls and having upper faces converging downward toward the roller.

13. The combination defined in claim 1, further comprising means for detecting rotation of the roller and for shifting the upstream blade from the engaged to the disengaged position when the roller rotates.

14. The combination defined in claim 1, further comprising a spring operatively engaging and urging the upstream blade into the engaged position.

15. The combination defined in claim 1 wherein the edges of both blades are elastomeric strips.

* * * * *